US008122788B2

(12) United States Patent
Gauthier et al.

(10) Patent No.: US 8,122,788 B2
(45) Date of Patent: Feb. 28, 2012

(54) VARIABLE GEAR RATIO RATCHET

(75) Inventors: Michael T. Gauthier, Grafton, WI (US); Mara C. Schwartz, Minneapolis, MN (US); Robert F. Miller, Grafton, WI (US)

(73) Assignee: Gauthier Biomedical, Inc., Grafton, WI (US)

( * ) Notice: Subject to any disclaimer, the term of this patent is extended or adjusted under 35 U.S.C. 154(b) by 0 days.

(21) Appl. No.: 12/689,065

(22) Filed: Jan. 18, 2010

(65) Prior Publication Data

US 2010/0180732 A1 Jul. 22, 2010

Related U.S. Application Data

(63) Continuation-in-part of application No. 12/354,939, filed on Jan. 16, 2009, now Pat. No. 7,987,745.

(51) Int. Cl.
*B25B 17/00* (2006.01)

(52) U.S. Cl. ..... 81/57.31; 81/58.3

(58) Field of Classification Search ..... 81/57.3, 81/58.3, 57.31, 57, 57.22, 60; 475/270, 271, 475/296–300

See application file for complete search history.

(56) References Cited

U.S. PATENT DOCUMENTS

| | | | | | |
|---|---|---|---|---|---|
| 311,255 | A * | 1/1885 | Pedersen | 475/296 |
| 919,156 | A * | 4/1909 | Gilmore | 81/57.31 |
| 2,721,591 | A * | 10/1955 | Criswell | 81/57.31 |
| 4,341,292 | A * | 7/1982 | Acevedo | 81/58.3 |
| 4,846,027 | A * | 7/1989 | Lu | 81/57.3 |
| 5,947,212 | A * | 9/1999 | Huang | 81/57.3 |
| 6,035,746 | A * | 3/2000 | Lin | 81/57.31 |
| 6,899,653 | B2 * | 5/2005 | Murphy | 81/57.31 |

* cited by examiner

*Primary Examiner* — Hadi Shakeri
(74) *Attorney, Agent, or Firm* — Boyle Fredrickson S.C.

(57) ABSTRACT

This invention relates to a fastener driving device including a variable ratio gear mechanism that enables the ratio of the rotation of the handle to the rotation of a driving bit extending from the handle to be varied to allow the bit to rotate at different speeds from the handle. The device includes a gear mechanism disposed within a housing for the device that includes a locking member and a biasing member. The biasing member urges the locking member into engagement with the gear mechanism to lock the gear mechanism in a configuration for a 1:1 gear ratio. A selector switch is secured to the device over the gear mechanism and is operable to move the locking member into and out of engagement with the planetary gears against the bias of the biasing member to provide an increased gear ratio for the gear mechanism when desired.

9 Claims, 14 Drawing Sheets

VARIABLE GEAR RATIO RATCHET

CROSS-REFERENCE TO RELATED APPLICATIONS

This application claims priority as a continuation-in-part application from U.S. Non-Provisional patent application Ser. No. 12/354,939, filed on Jan. 16, 2009 now U.S. Pat. No. 7,987,745, the entirety of which is hereby expressly incorporated by reference herein.

FIELD OF THE INVENTION

This invention relates to a device for driving or removing fasteners from a substrate, such as a screwdriver, that includes a ratcheting mechanism to assist in driving the fastener.

BACKGROUND OF THE INVENTION

In the past a variety of different types of devices have been developed to drive fasteners into a substrate for various purposes. The type of device most often utilized to drive the fastener is a screwdriver or similar device that translates the rotation of the screwdriver by the individual into rotation of the fastener to urge the fastener into the desired substrate.

On many occasions, the particular location where the fastener needs to be located, or the type of substrate into which the fastener is to be driven creates a certain amount of difficulty in driving the fastener into the substrate. To provide some assistance in driving the fasteners in these more difficult situations, many of these devices are constructed with a ratcheting mechanism. The ratcheting mechanism allows the individual to restrict the rotation of the driver to a single direction, which eases the difficulty of driving the fastener.

Nevertheless, the devices, whether including a ratcheting mechanism or not, produces only a one to one ratio between the rotation of the device by the individual and the corresponding rotation of the fastener. As a result, it normally takes a significant amount of time to completely drive the fastener into the substrate.

In an attempt to increase the speed of driving a fastener into a substrate, certain prior art devices have been developed that can alter the ratio of the rotation of the handle of the device with respect to the driving bit of the device, to thereby increase the speed of driving the fastener into the substrate. One device of this type is disclosed in Murphy U.S. Pat. No. 6,899,653, which discloses a fastener with a gear assembly. In this device, the fastener includes a plate having a number of openings formed therein. The plate is connected to a sun gear which engages a number of planetary gears positioned between the sun gear and a ring gear disposed on the exterior of the device. When engaged with and allowed to rotate freely with the planetary gears and the ring gear, the sun gear rotates at a speed faster than the rotation of the handle, at a ratio of approximately four rotations of the sun gear for each revolution of the handle. Further because the driving bit for the device is fixed to the sun gear, the bit also rotates at the 4:1 ratio to drive the fastener engaged with the bit into the substrate at a speed greater than the rotation of the device handle by the individual.

The device also includes a switch located on the exterior of the device, and that is slidably movable with respect to the device. The switch includes a pin that can be selectively engaged and disengaged with one of the openings in the plate to which the sun gear is attached. Thus, when the pin is engaged with the plate, the pin prevents the plate and the sun gear from rotating separately from one another, so that the sun gear, as well as the bit connected thereto, and the handle rotate in a 1:1 ratio.

However, while providing a design that enables the device to be operated at different gear ratios to increase the speed of the driving bit as desired, the device requires a separate switching mechanism to transition the device between the different gear ratios. This requires a separate mechanism to be formed on the device and significantly complicates the construction and operation of the device. In addition, the switch mechanism relies solely on the frictional engagement of the pin with the plate to main the lock between the plate and the pin, such that the switch mechanism can be inadvertently disengaged in a relatively easy manner.

Accordingly, the prior art does not satisfy the needs and solutions required for devices of this type, such that it is desirable to develop a fastener-driving device that provides a simple construction and mechanism for altering the speed of rotation of the driving shaft relative to the handle.

SUMMARY OF THE INVENTION

It is one object of the present invention to provide a fastener driving device including a variable ratio gear mechanism that enables the ratio of the rotation of the handle to the rotation of a driving bit extending from the handle to be varied to allow the bit to rotate at different speeds from the handle. The device includes a gear mechanism disposed within a housing for the device that includes a sun gear attached to a shaft extending through the housing and to which a driving bit can be connected. A number of planetary gears are disposed around the sun gear and operably engage the sun gear and the shaft with a ring gear secured to the housing. The planetary gears are disposed on a cover that is connected to a handle for the device, such that the rotation of the handle causes the planetary gears to rotate relative to the sun gear.

The cover also encloses a locking member and a biasing member between the cover and the handle. The biasing member urges the locking member into engagement with the sun gear to lock the sun gear and the planetary gears to one another. A selector switch is secured to the device over the gear mechanism and is operable to move the locking member into and out of engagement with the planetary gears against the bias of the biasing member.

According to another object of the present invention, the selector switch is continually biased into engagement with the planetary gears by the biasing member to avoid any inadvertent disengagement of the switch and consequent alteration of the gear ratio at which the device is operating.

According to still another object of the present invention, the locking member and the switch can be combined to further simplify the construction the construction for the device.

Numerous additional objects, aspects and advantages of the present invention will be made apparent from the following detailed description taken together with the drawing figures.

BRIEF DESCRIPTION OF THE DRAWINGS

The drawings illustrate the best mode of practicing the present invention.

In the drawings:

FIG. 18 is a rear isometric view of the locking member of FIG. 17;

DETAILED DESCRIPTION OF THE INVENTION

Figure 1:
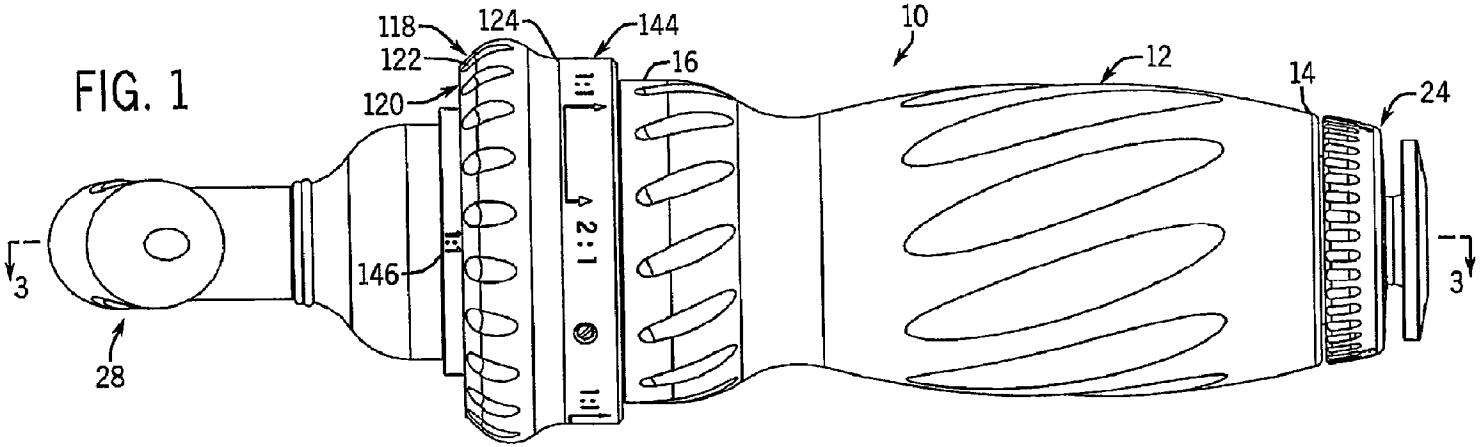
FIG. 1 is a side pan view of a first embodiment of the driving device constructed according to the present invention in a locked position.

With reference now to the drawing figures in which like reference numbers represent like features throughout the application, a tool or device constructed according to the present invention is indicated at 10 in FIG. 1. The device 10 includes a housing 12 having a first end 14 and a second end 16. The shape of the housing 12 can be made to have any desired and ergonomic configuration, and can be made of any suitable material, with a material that is both impervious to fluids and able to be sterilized in any conventional manner being especially preferred. Additionally, the material forming the housing 12 can be selected from a material having the desired properties that can be molded around the other components used in the formation of the device 10.

Referring now to FIGS. 1-4C, the housing 12 includes a central passage 18 extending therethrough that includes a first expanded section 20 at the first end 14 and a second expanded section 22 at the second end 16. Within the first expanded section 20 is disposed a suitable ratcheting mechanism 24, such as that disclosed in co-pending and co-owned U.S. patent application Ser. No. 12/241,696, the entirety of which is expressly incorporated by reference herein in its entirety. The ratcheting mechanism 24 is held in the first expanded section 20 in any suitable manner to maintain fluid-impervious and sterilizable construction of the device 10. The mechanism 24 is also capable of releasably receiving and engaging a driving member (not shown) therein that is used to directly engage a fastener (not shown) to enable the device 10 to drive the fastener into the desired substrate (not shown). The ratcheting mechanism 24 is preferably operable to restrict the rotation of the driving member to one direction, or to hold the driving member stationary when the device 10 is in use.

A shaft 26 is disposed within and extends through the central passage 18 between the expanded sections 20 and 22. The shaft 26 is held within the passage 18 by a number of bearings 27 that allow the shaft 26 to rotate freely in the passage 18. The shaft 26 is also operably connected at one end to the ratcheting mechanism 24, such that the rotation of the shaft 26 is controlled by the operation of the ratcheting mechanism 24. Opposite the ratcheting mechanism 24, the shaft 26 is affixed to a handle 28 that can be grasped and turned by an individual in order to operate the device 10. The handle 28 can have any desired shape and configuration to maintain the fluid-proof and sterilizable structure, but in a preferred embodiment is formed of an interior component 30 formed of a rigid material and an outer resilient cover 32. The interior component 30 enables the handle 28 to accommodate the stresses utilized in the operation of the device 10, while the cover 32 provides a softer feel to the handle 28 when in use. The interior component 30 is not affixed to the shaft 26 opposite the ratcheting mechanism 24, such that the turning motion applied to the handle 28 is not directly transmitted to the shaft 26 to turn the shaft 26 along with the handle 28, but is directed to a gear mechanism 34 operably connecting the handle 28 and the shaft 26.

Between the handle 28 and the housing 12 is disposed a gear mechanism 34 that is disposed within the second expanded section 22 of the passage 18. The mechanism 34 includes a support member 36 that is engaged with the handle 28. The support member 36 includes an outer end 38 including an inwardly extending recess 40. The recess 40 has a rim 42 that has a diameter greater than the outer diameter of the handle 28, such that the handle 28 can be engaged with the support member 36 within the recess 40. Preferably there is a sealing member 44 disposed in the recess 40 to be engaged with the handle 28 to provide a fluid-tight engagement of the handle 28 with the support member 36.

The support member 36 also includes a projection 46 extending outwardly from the recess 38. The projection 46 is inserted into the handle 28 to further affix the handle 28 the housing 12. The projection 46 also includes a central opening 48 located concentrically within the projection 46 that extends completely through the projection 46 and the support member 36. The opening 48 is additionally disposed in concentric alignment with the passage 18 in the housing 12, and has a sufficient diameter to enable the shaft 26 to extend through the opening 48 in order to be engaged within the handle 28.

Opposite the projection 46, the support member 36 includes a number of attachment members 50. The attachment members 50 extend outwardly from the support member 36 and each include a blind bore 52 therein. The attachment members 50 are disposed around the opening 48, and taper inwardly towards the opening 48. Each attachment member 50 includes a pair of flat side walls 54, and are separated from one another by a flat section 56 of the support member 38, for a purpose to be described.

Between the projection 46 and the attachment members 50, the support member 36 includes a radially outwardly extending flange 58. The flange 58 includes a pair of flat sides 60 disposed opposite one another. The flange 58 serves as an engagement point for a number of biasing members 62 that are positioned on the flange 58 around the attachment members 50. The biasing members 62 can have any desired form, but are preferably Belleville springs 64. The biasing members 64 are retained against the flange 58 by a cover 66 secured to the support member 36. Preferably, the cover 66 is circular in shape and includes an axially extending wall 68 extending outwardly therefrom. Within the wall 68 are located a number of slots 70. Each slot 70 is preferably spaced equidistant from the remaining slots 70 around the perimeter of the wall 68, and includes a pair of notches 72 and 74 spaced from one another by a spacing section 76. The notch 74 is formed with a depth greater than the depth of the notch 72, for a purpose to be described.

The cover 66 also includes a central aperture 77 and a number of apertures 78 therein that are aligned with the bores 52 in the respective attachment members 50. The cover 66 is affixed to the attachment members 50 over the biasing members 64 by screws 80 inserted through the apertures 78 and into engagement within the bores 52 in the attachment members 50. The screws 80 are preferably formed with an end portion 82 on which threads 84 are located for engagement within the bore 52, a smooth shaft 86 extending away from the end portion 82, and a head 88 used to engage the end portion 82 within the bore 52. The smooth shaft 86 is present to enable a planetary gear 90 to be mounted to each screw 80. The planetary gear 90 is formed of any suitable material with a first width $W_1$, and includes a central opening 92 and a number of teeth 94 disposed around the periphery of the gear 90. The central opening 92 is dimensioned to have a diameter larger than that of the shaft 86 for the screw 80, such that the shaft 86 can be inserted through the opening 92, preferably with sufficient space for a bearing 96 to be positioned between the shaft 86 and the gear 90 within the opening 92.

Around the planetary gears 90 is located an annulus or ring gear 98. The ring gear 98 is affixed to the housing 12 around the second expanded section 22 at the second end 16 of the housing 12. The ring gear 98 includes a number of bores 100 through which suitable fasteners 102 are inserted to engage the ring gear 98 around the periphery of the second expanded section 22. Additionally, the ring gear 98 is formed to have a width $W_1$ corresponding to the width of the planetary gears 90, such that the ring gear 98 and planetary gears 90 are essentially coplanar with one another. The ring gear 98 further includes a number of teeth 104 disposed along the inner periphery of the ring gear 98 that are engaged by the aligned teeth 94 disposed on each of the planetary gears 90, such that rotation of the planetary gears 90 causes the rotation of the ring gear 98, and vice versa.

The planetary gears 90 are secured to the cover 66 opposite the support member 36, such that the gears 90 do not interfere with the operation of the biasing members 64, and around a space 105 formed in the center of the cover 66. The space 105 allows for the shaft 26 to extend therethrough, and has a diameter large enough to accommodate a sun gear 106 therein. The sun gear 106 is formed as a hollow sheath 108 disposed around the shaft 26 that includes a central part 110, from which extend a number of teeth 112, and a pair of end parts 114 that extend axially from each end of the central part 110. The sheath 108 is affixed to the shaft 26, such that the sheath 108 rotates in conjunction with the shaft 26. Further, the end parts 114 each support a bearing 116 thereon that engages the interior of the passage 18 to hold the sun gear 106 securely within the device 10, while also allowing the gear 106 and shaft 26 to rotate freely therein. Also, the teeth 112 on the central part 110 contact and engage the teeth 94 on the planetary gears 90, such that rotation of the sun gear 106 will cause consequent rotation of the planetary gears 90, or vice versa.

Additionally, the central part 110 has a second width $W_2$, which is greater than the width $W_1$ of the planetary gears 90 and the ring gear 98, such that the teeth 112 on the central part 110 axially extend beyond the teeth 94 on the planetary gears 90 in both axial directions. The portion of the teeth 112 that extend through the space 104 in the center of the cover 66 can be selectively contacted by a switch 118 to control the gear ratio achieved by the sun gear 106, planetary gears 90 and ring gear 98.

The switch 118 includes a ring 120 slidably mounted to the exterior of the support member 36. The ring 120 includes an enlarged section 122, positioned adjacent the handle 28, and a reduced section 124, disposed around the wall 68 of the cover 66 and the ring gear 98, that are joined to or integrally formed with one another to form the ring 120. The enlarged section 122 includes a radially inwardly extending rim 126 that is slidably positioned around the support member 36 between the rim 42 and the flange 58 to operably connect the ring 122 to the support member 36.

Looking now at FIGS. 2, 4B, 4C, and 5-7, opposite the rim 126, the reduced section 124 of the ring 120 includes a number of openings 128 extending radially therethrough. The openings 128 receive suitable fasteners 130 therein which operate to connect the reduced section 124 of the ring 120 to a locking member 132. The locking member 132 is formed of any suitable, and preferably rigid material, and is shaped to have a fan blade-like shape, with a number of, e.g., preferably three, sections 134 extending radially outwardly from a central hub 136. Each of the sections 134 is dimensioned to be positionable within the flat sections 56 of the support member 36 formed between the attachment members 50, and preferably have an area less than the area of the flat sections 56 to allow some movement of the sections 134 with respect to the flat sections 56. The sections 134 also each include a bore 138 at their outer ends within which the fastener 130 is inserted to engage the ring 120 with the locking member 132. In one embodiment the bore 138 is disposed in an off-center position within the section 134. Each of the fasteners 130 is inserted through a slot 70 in the wall 68, which enables the fastener 130 to function as a stop for the movement of the locking member 132 with respect to the wall 68 and the cover 66.

The locking member 132 is also continuously engaged by the biasing members 64, such that the biasing members 64 urge the locking member 132 away from the support member 36 and towards the cover 66. Also, due to the positioning of the fasteners 130 within the slots 70, the biasing members 64 press the fasteners 130 against the inner end of one or the notches 72 or 74 formed in the slot 70, to maintain the fasteners 130, and consequently the locking member 132, at the particular location within the slot 70.

Figure 2:
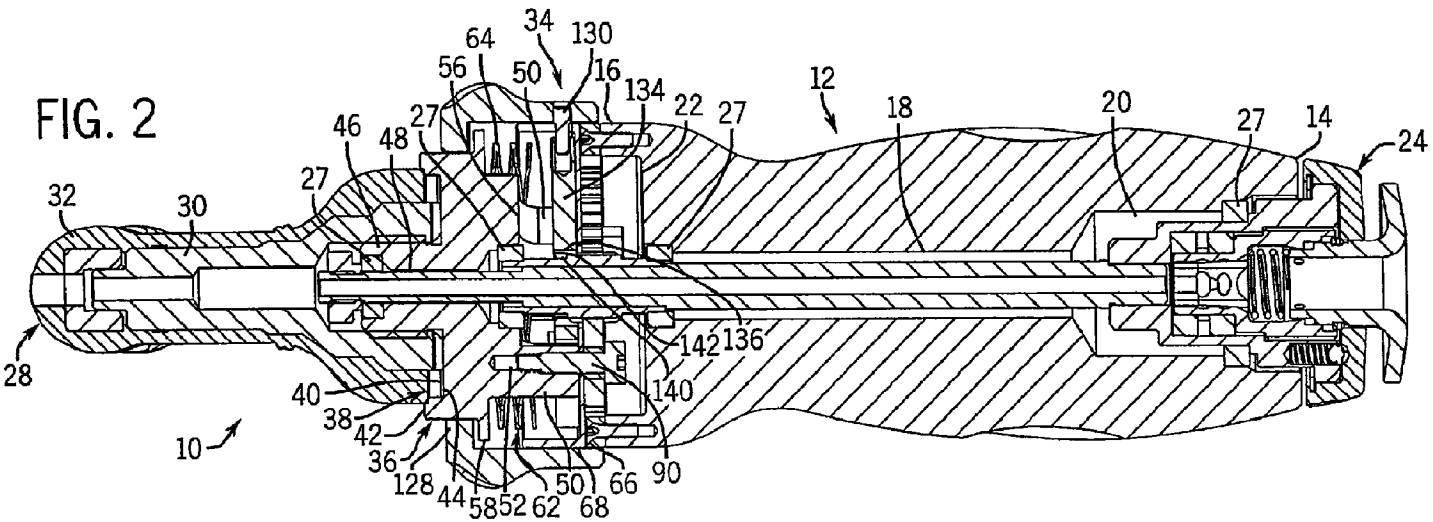
FIG. 2 is a cross-sectional view of the driving device of FIG. 1.
Figure 3:
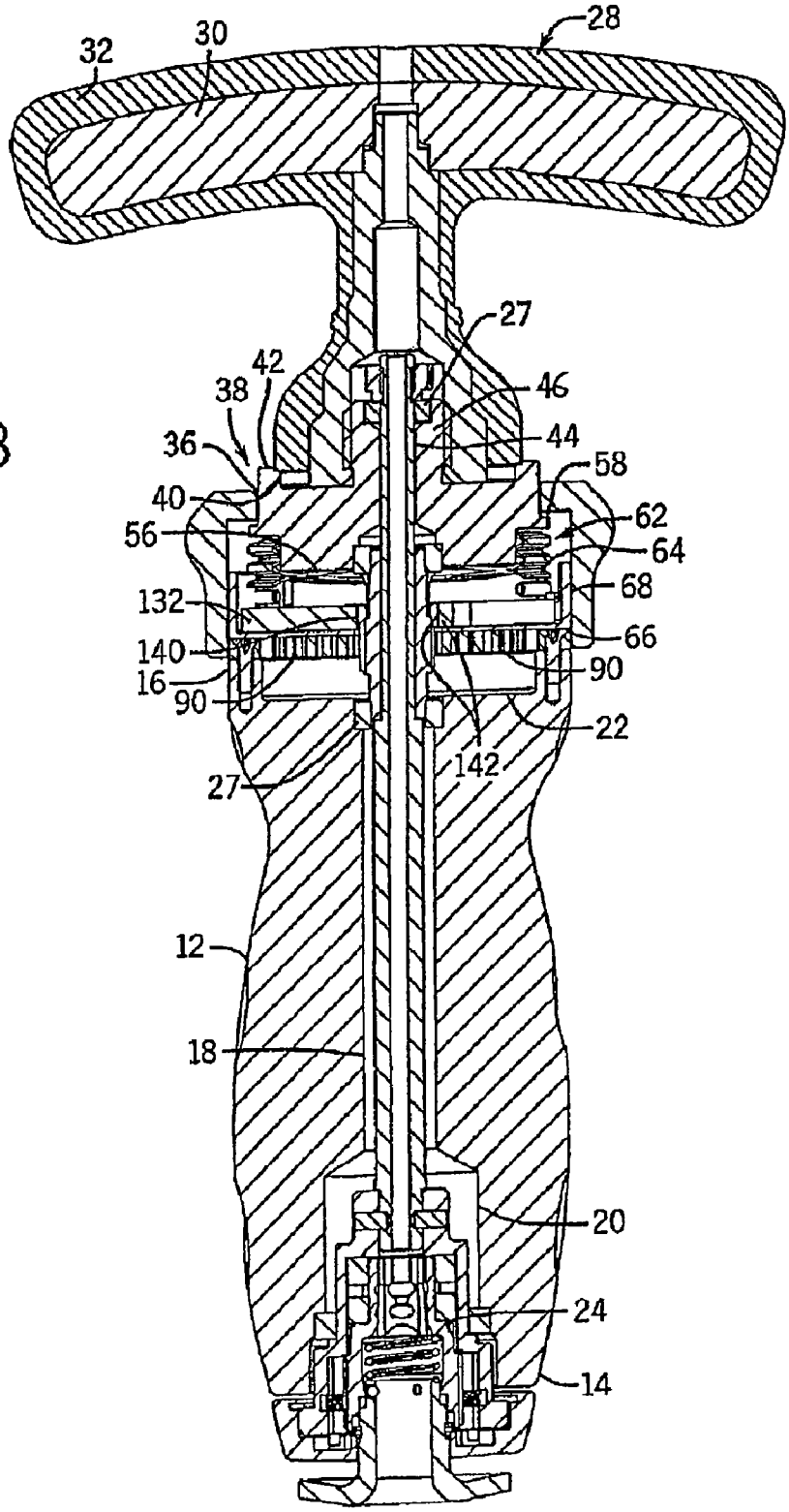
FIG. 3 is a cross-sectional view along line 3-3 of FIG. 1.
Figures 4A, 4B:
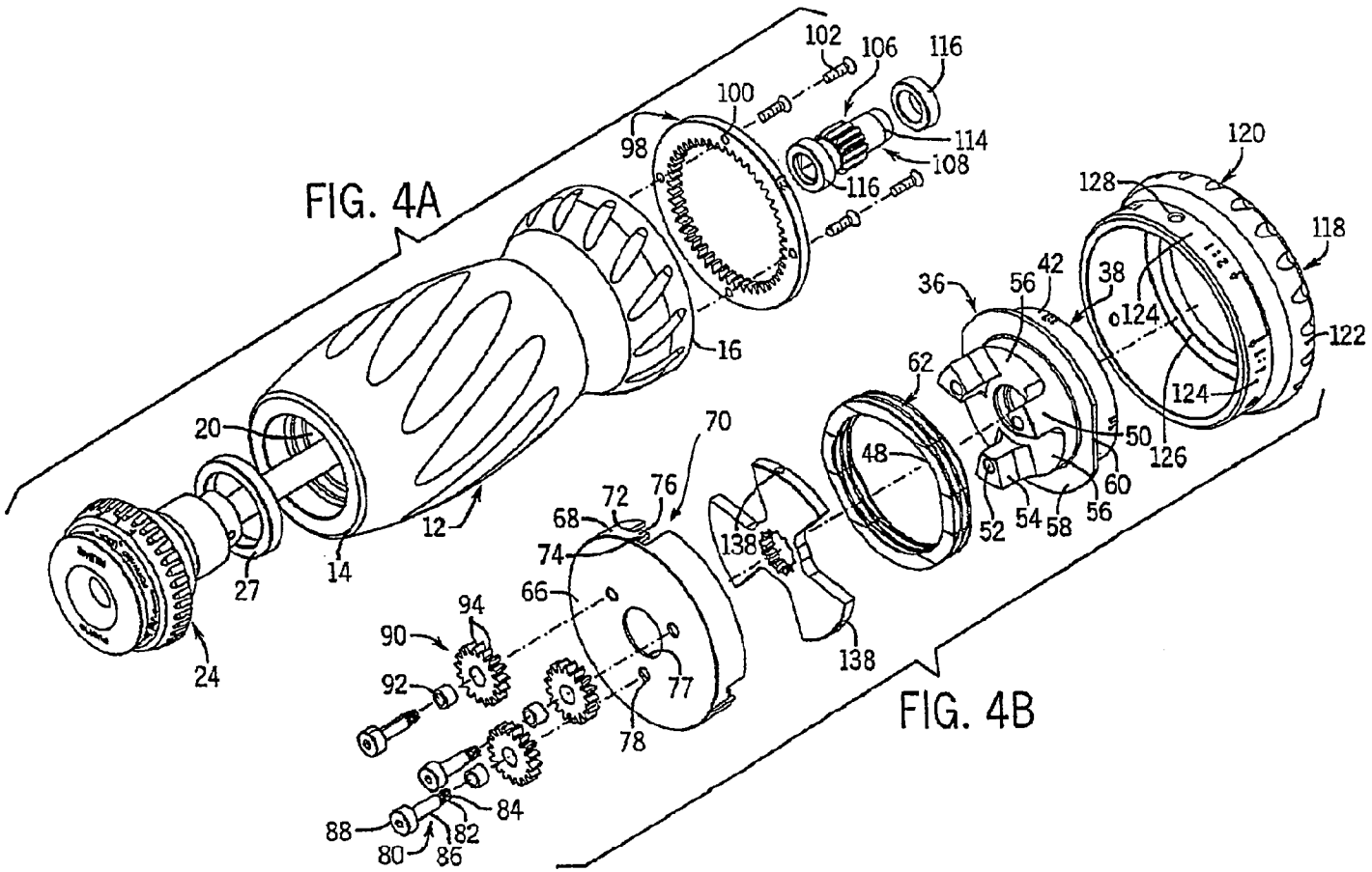
FIGS. 4A-4C are isometric exploded views of the device of FIG. 1.
Figure 4C:
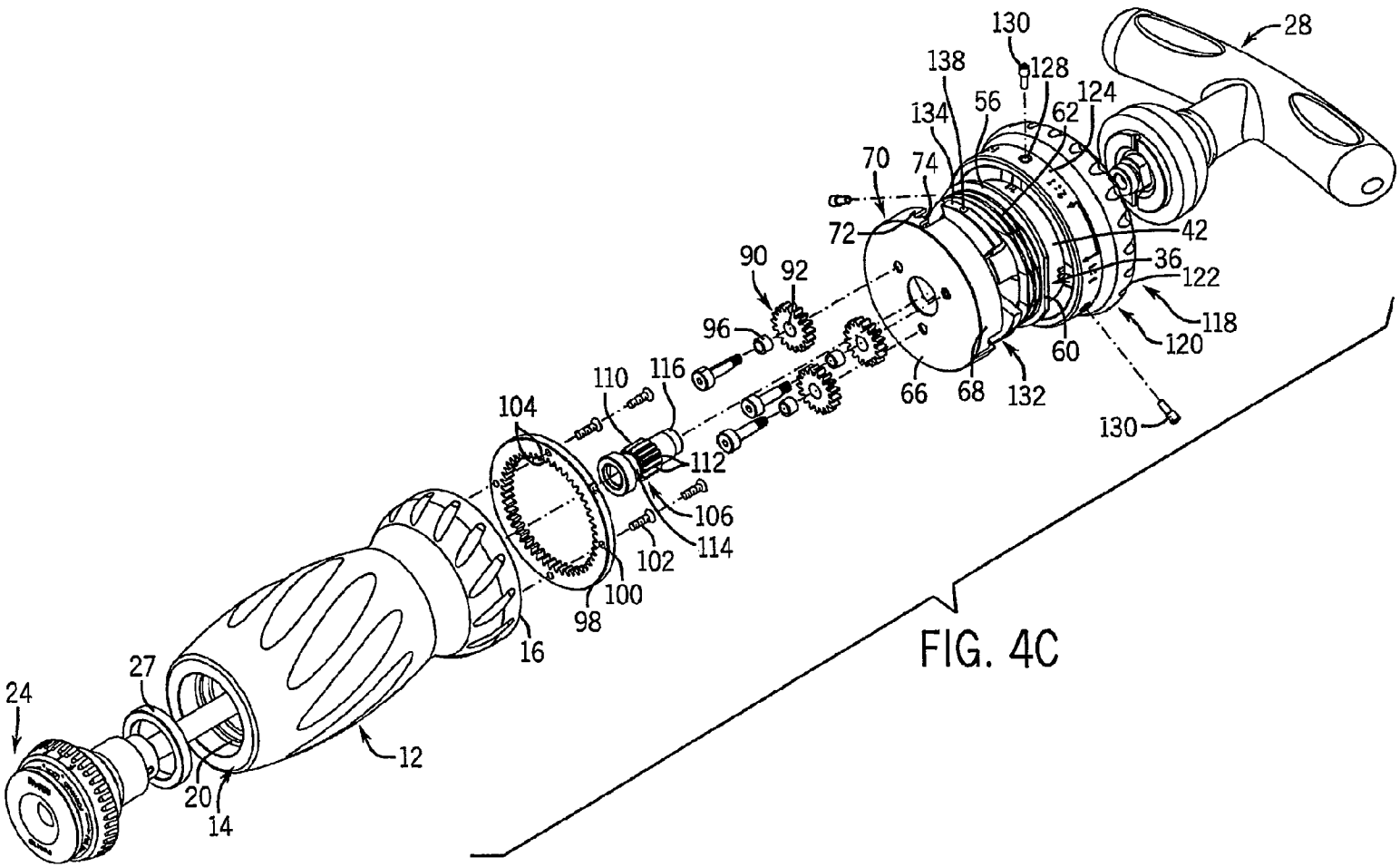
Figure 5:
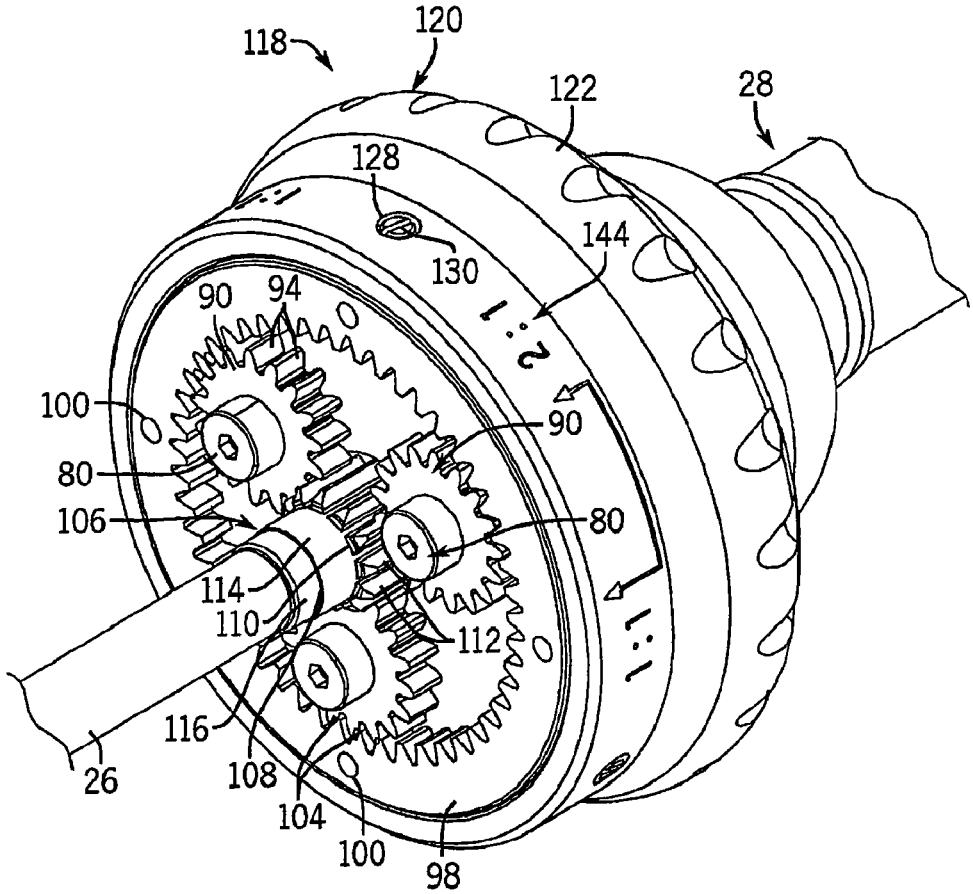
FIG. 5 is a partially broken away isometric view of the gear mechanism of the device of FIG. 1.
Figure 6:
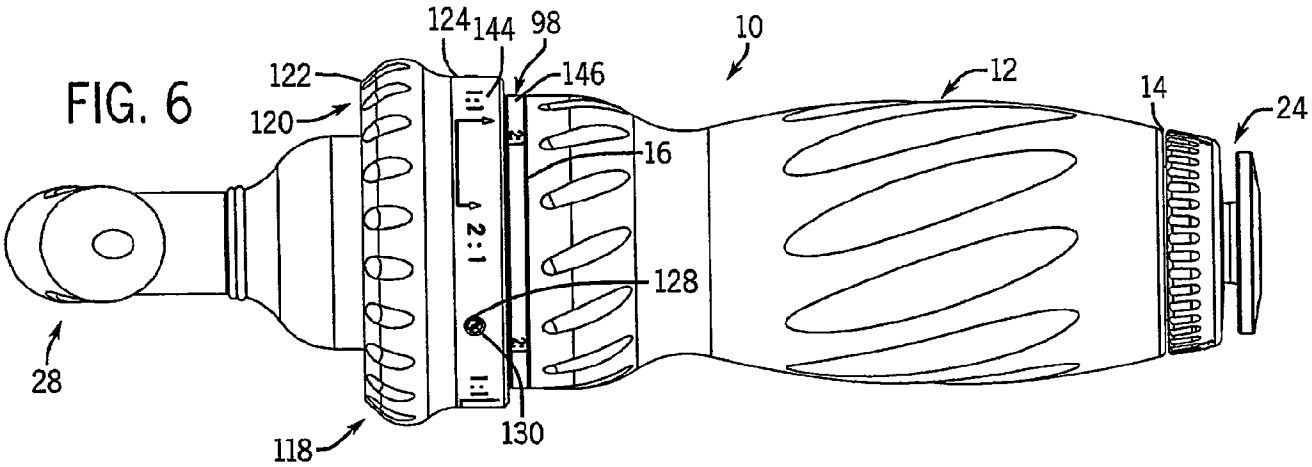
FIG. 6 is a side pan view of the driving device of FIG. 1 in an unlocked position.
Figure 7:
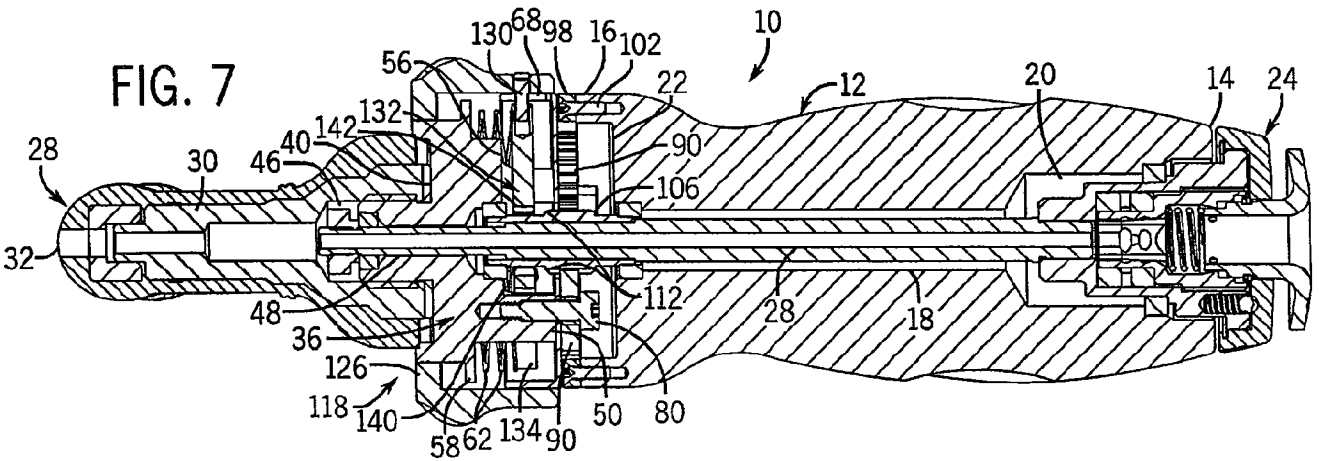
FIG. 7 is a cross-sectional view of the driving device of FIG. 6.

Looking now at FIGS. 2, 3 and 7, the hub 136 of the locking member 132 also defines an opening 140 therein through which the shaft 26 can extend. The opening 140 also includes a number of teeth 142 disposed along the periphery of the opening 140 that are selectively engageable with the teeth 112 on the sun gear 106. When the fasteners 130 are disposed in the deeper notch 74 (FIG. 2), the teeth 142 in the opening 140 are positioned in engagement with the teeth 122 on the sun gear 106. In this position, due to the engagement of handle 28 with the shaft 26 via the support member 36, cover 66 and the locking member 132, when rotating the handle 28 while grasping the housing 12, the rotation of the shaft 26 is in a 1:1 ratio with the rotation of the handle 28. Conversely, when the fasteners 130 are disposed within the notch 72 in each slot 70 (FIG. 7), the opening 140 and teeth 142 are spaced from the teeth 112 on the sun gear 106. Therefore, when the handle 28 is rotated to turn the shaft 26 while holding the housing 12 stationary, the rotation of the handle 28 is transmitted through the support member 36 to the cover 66, which in turn rotates the planetary gears 90 due to their movement along the ring gear 98. The rotation of the planetary gears 90 it directly transmitted to the sun gear 106, which provides 2:1 gear ratio to rotate the shaft two revolutions for every single revolution of the handle 28.

In either position, the switch 118 maintained in the selected position during operation of the device 10 due to the force exerted by the biasing members 64 on the locking member 132 and the depth of the notches 72 and 74, which keeps the fasteners 130 disposed within the selected notch 72 or 74. When it I desired to change the gear ratio for the device 10, the switch 118 is grasped and urged towards the handle 28 against the bias of the biasing members 64. Once the fasteners 130 have been moved out of the notch 72 or 74 in which they were located, the switch 118 can be rotated with respect to the cover 66 and support member 36 to position the fasteners 130 in alignment with the other notch 72 or 74 corresponding to the desired gear ratio. At that point, the switch 118 can be released and the biasing members 64 will urge the fasteners 130 into the desired notch 72 or 74 to reengage the switch 118 with the cover 66. Further, the depth of the notches 72 and 74 are formed to enable the locking member 132 to be positioned out of engagement with the sun gear in notch 72, and in engagement in notch 74.

Preferably, the reduced section 124 of the ring 120 also includes indicia 144 thereon to assist in properly positioning the switch 118 in the location for the desired gear ratio. Further, both the support member 36 and the ring gear 98 can have printed indicia 146 on the exterior thereof indicating the gear ratio at which the device 10 is currently operating. This indicia 146 becomes exposed on the particular part of the device 10 when the switch 118 is moved into engagement with the notch 72 or 74 on the cover 66 corresponding to that gear ratio.

Figure 8:
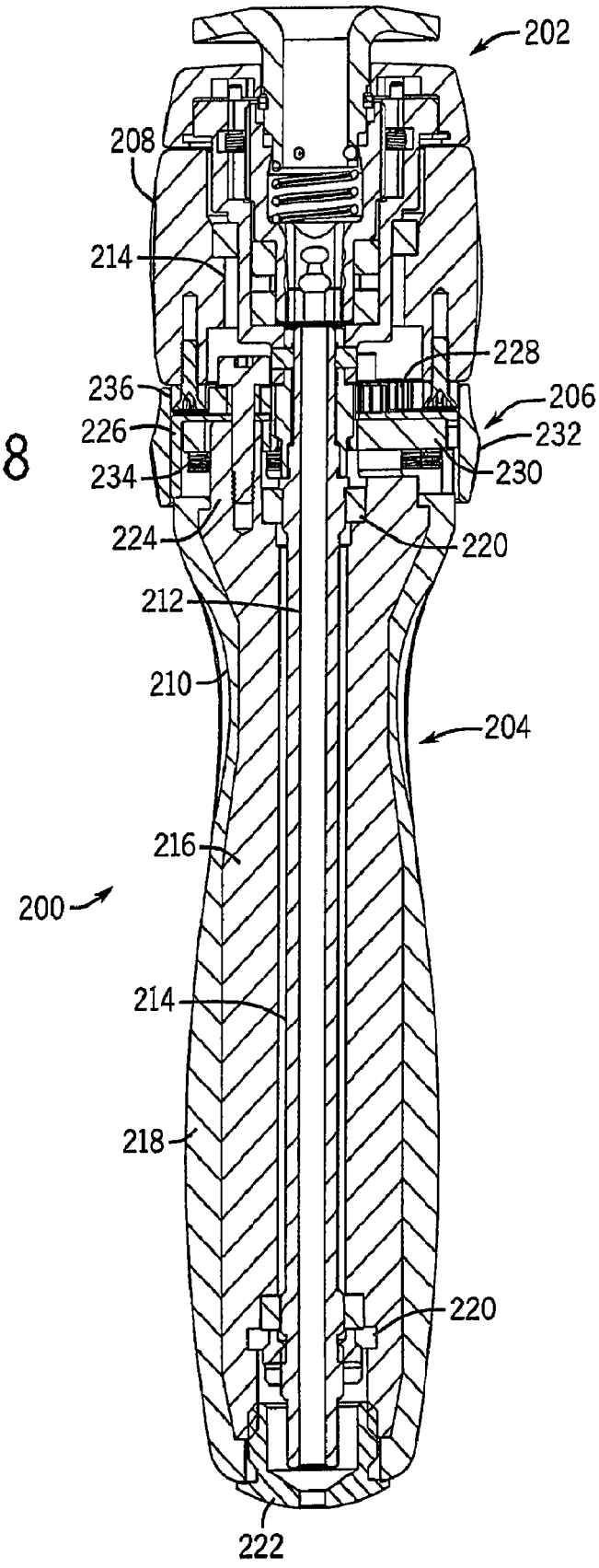
FIG. 8 is a cross-sectional view of a second embodiment of the driving device constructed according to the present invention.
Figure 9:
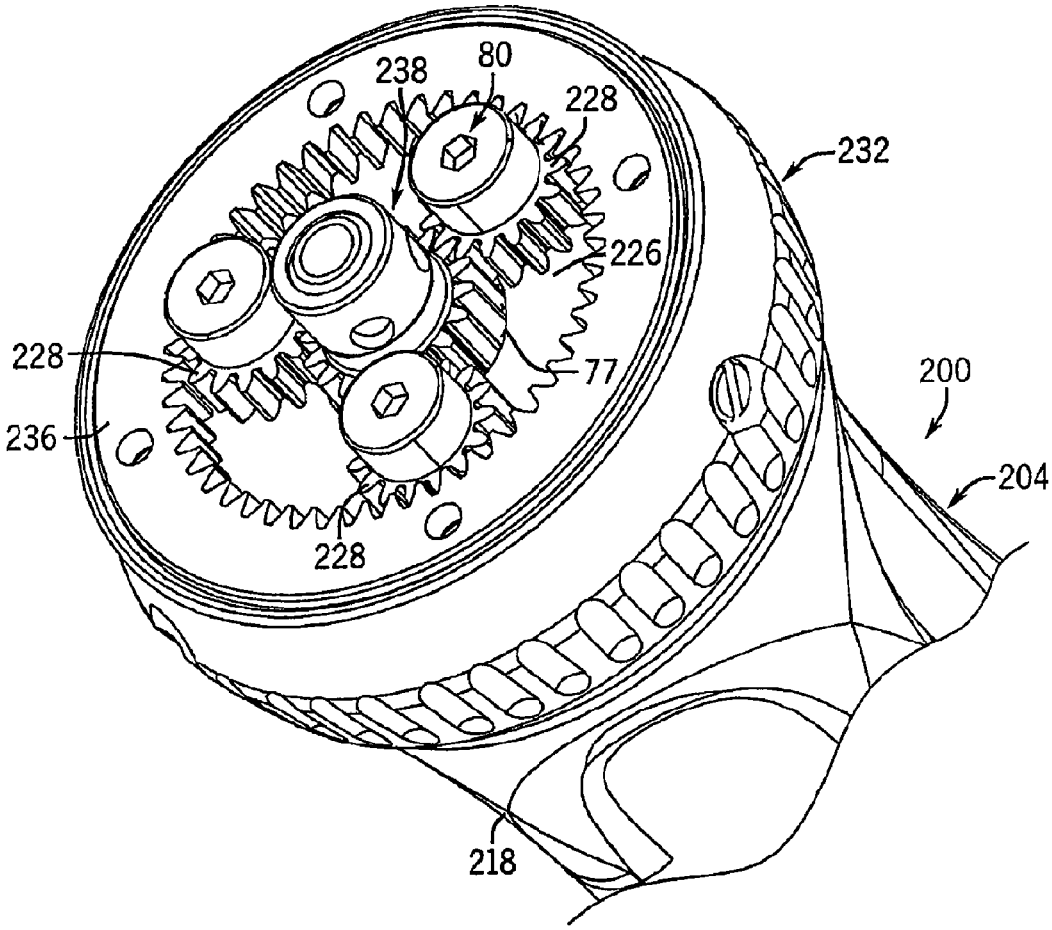
FIG. 9 is a partially broken away isometric view of the gear mechanism of the device of FIG. 8.
Figure 10:
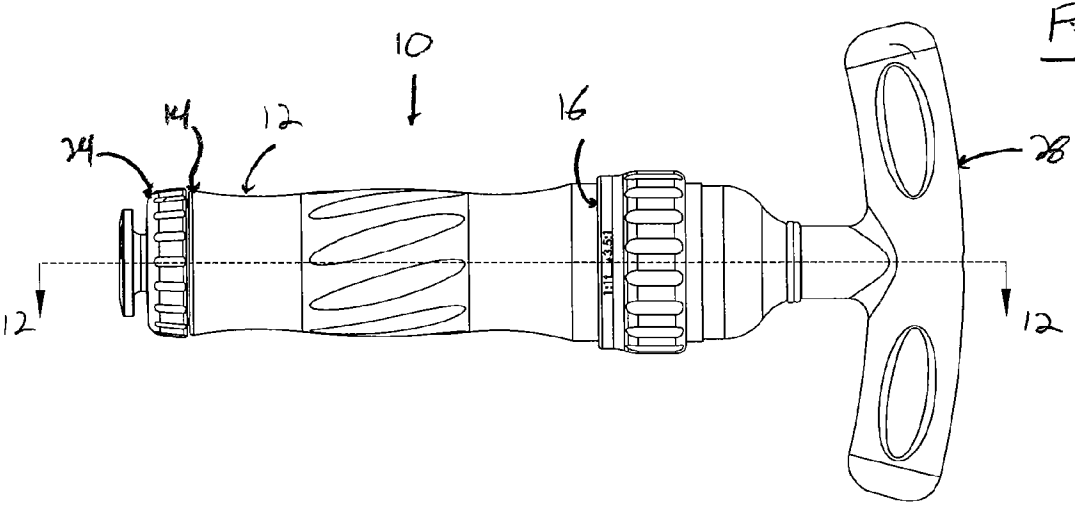
FIG. 10 is a side plan view of a third embodiment of the driving device constructed according to the present invention.

In a second embodiment of the device 200 shown in FIGS. 8 and 9, the device 200 includes the ratcheting mechanism 202 positioned on the same end of the housing 204 as the gear mechanism 206. In this embodiment, the housing 204 is formed of a front portion 208 and a rear portion 210 connected to one another via the shaft 212. The shaft 212 is connected to the ratcheting mechanism 202 that is disposed a part of the passage 214 formed in the front portion 208, and extends rearwardly from the mechanism 202 into the rear portion 210. The passage 214 in the rear portion 210 is formed within a generally rigid inner member 216, around which is formed a softer material member 218. The shaft 212 is engaged within the passage 214 by a number of bearings 220 to allow the shaft 212 to rotate without interference from the housing 204, and is covered opposite the ratcheting mechanism 202 by and end cap 222.

In this construction for the device 200, the support member 36 of the first embodiment is replaced by the inner member 216 of the housing 204, from which the various attachment members 224 extend. Thus, the cover 226, and planetary gears 228 are connected directly to the inner member 216, with the locking member 230 and switch 232 being connected to the cover 226 using the slots (not shown) and the notches (not shown) in the same manner as described above. Additionally, the biasing members 234 are also disposed between the inner member 16 and the locking member 230 to bias the locking member 230 into engagement with the slots in the cover 226, regardless of the selected gear ratio, in the same manner as described previously. The ring gear 236 is affixed to the front portion 208 and is positioned around and in engagement with the planetary gears 228 in the assembled device 200.

In the device 200, the switch 232 can be moved with regard to the cover 226 as described previously to shift the position of the locking member 230 and cause the rotation of the sun gear 238 on the shaft 212 at the desired ratio.

Figure 12:
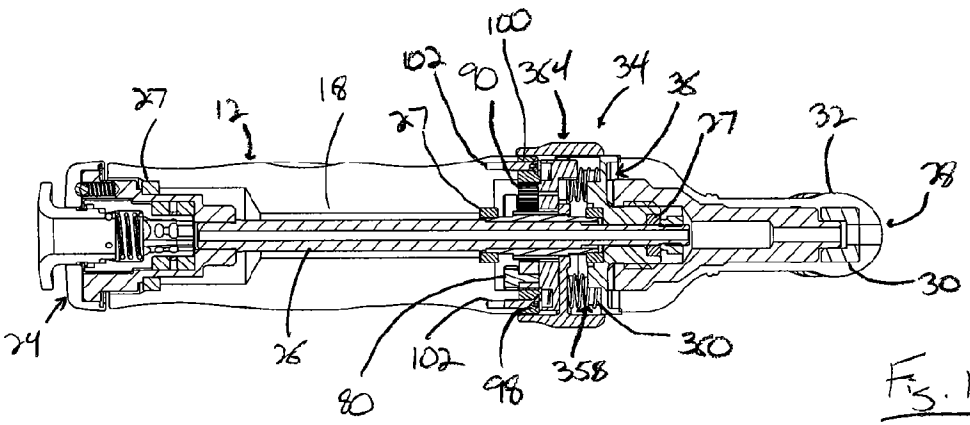
FIG. 12 is a cross-sectional view taken along line 12-12 of FIG. 10.
Figures 11A, 11B, 11C:
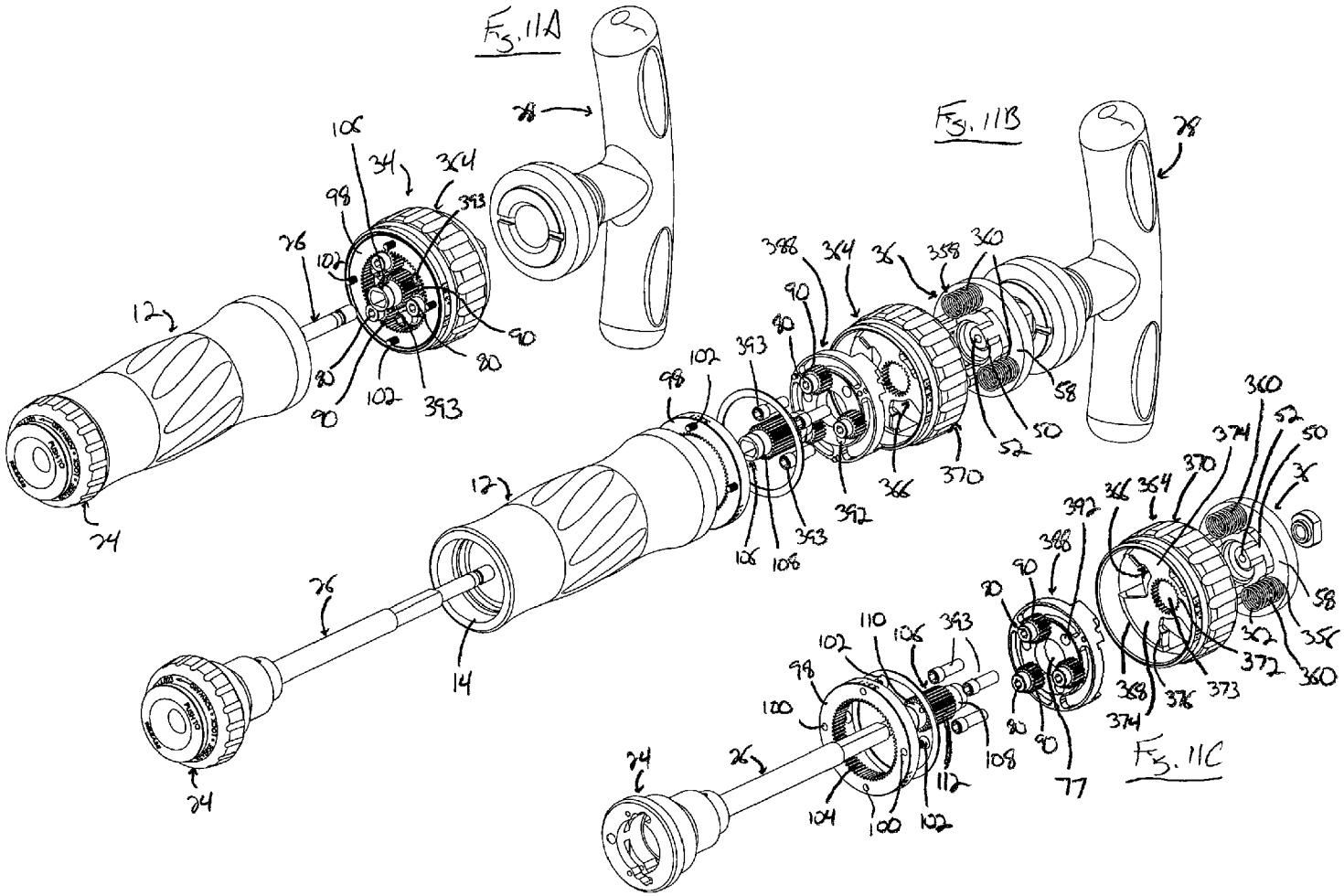
FIGS. 11A-11C are isometric exploded views of the device of FIG. 10.
Figure 14:
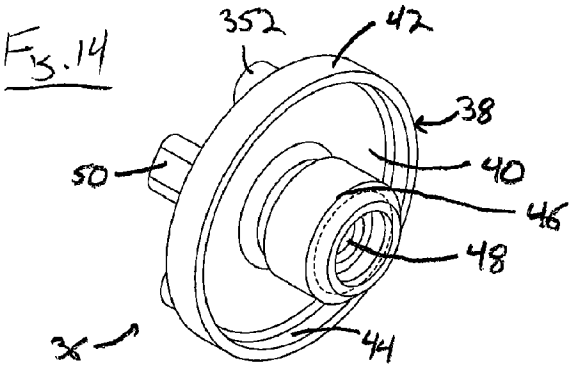
FIG. 14 is a rear isometric view of the support member of FIG. 13.
Figure 15:
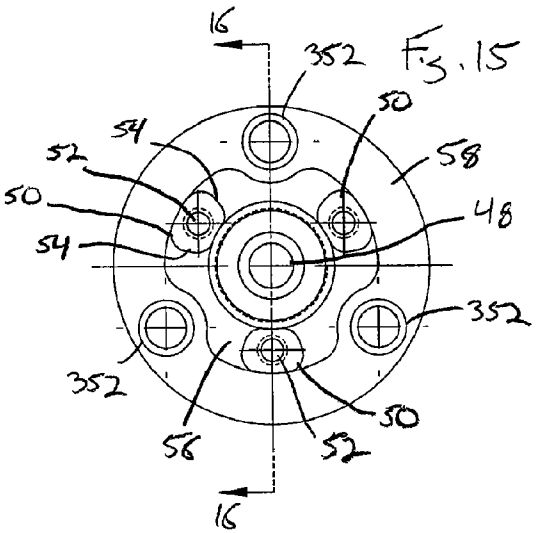
FIG. 15 is a front plan view of the support member of FIG. 13.
Figure 13:
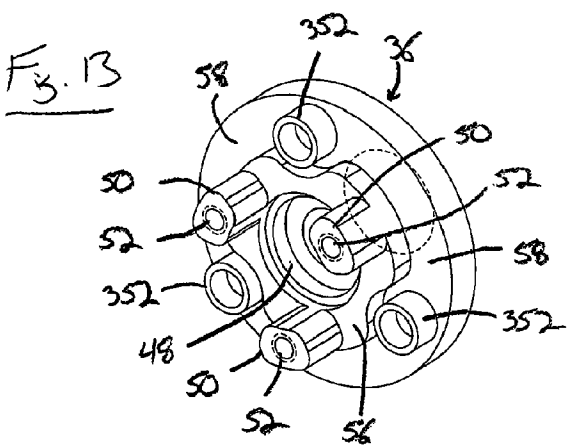
FIG. 13 is a front isometric view of a support member of the device of FIG. 12.
Figure 16:
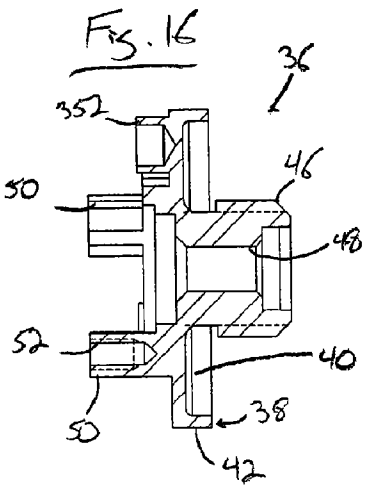
FIG. 16 is a cross-sectional view along line 16-16 of FIG. 15.
Figure 16:
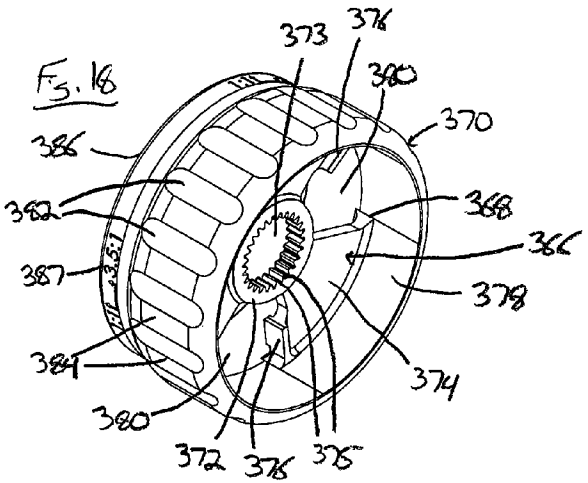
Figure 20:
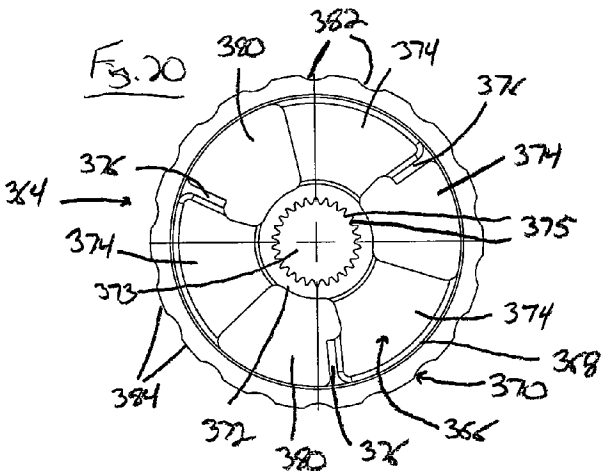
FIG. 20 is a rear plan view of the locking member of FIG. 17.
Figure 17:
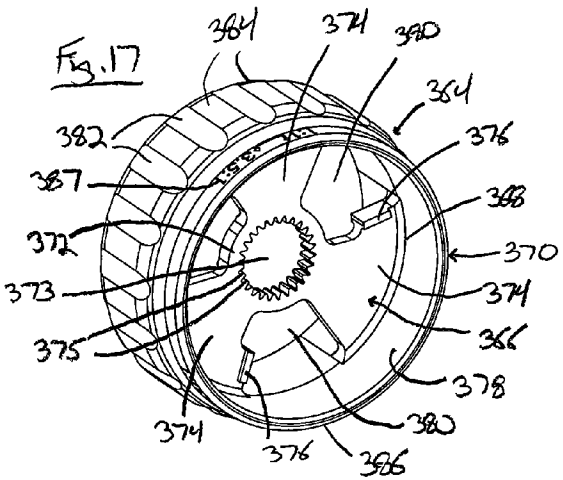
FIG. 17 is a front isometric view of a locking member of the device of FIG. 12.
Figure 19:
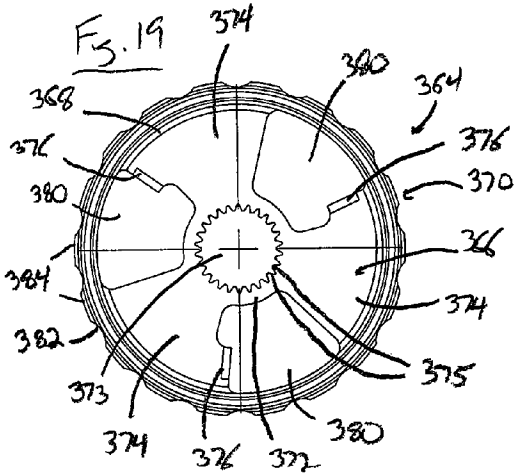
FIG. 19 is a front plan view of the locking member of FIG. 17.
Figure 21:
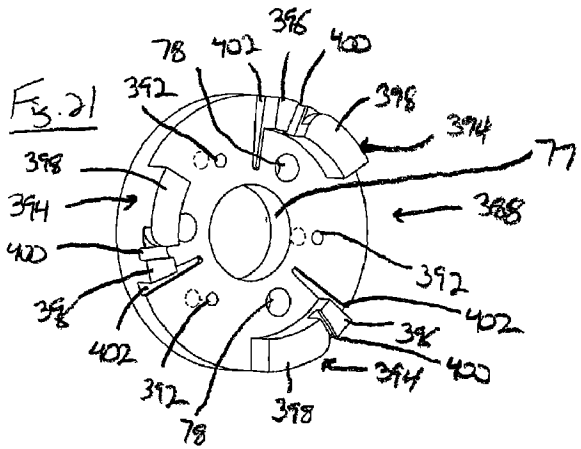
FIG. 21 is a front isometric view of a plate member of the device of FIG. 12.
Figure 23:
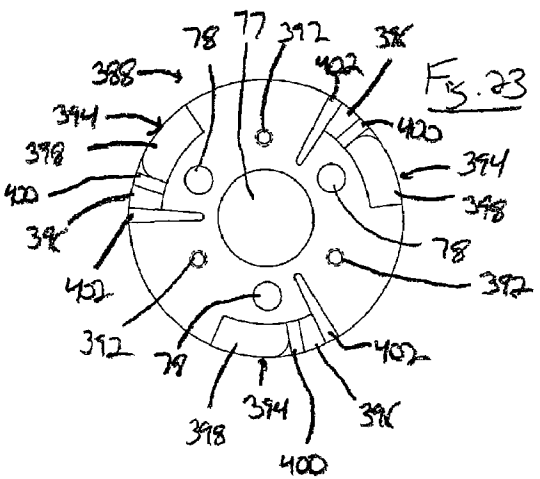
FIG. 23 is a front plan view of the plate member of FIG. 21.
Figure 22:
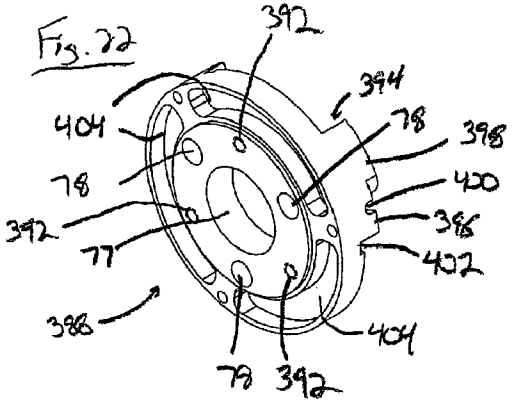
FIG. 22 is a rear isometric view of the plate member of FIG. 21.
Figure 24:
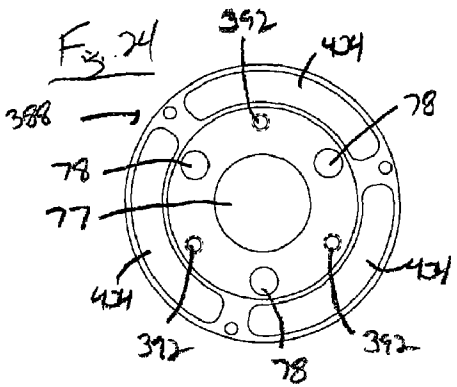
FIG. 24 is a rear plan view of the plate member of FIG. 21.

A third embodiment of the gear mechanism 34 for the tool 10 is shown in FIGS. 10-26, where, as in the previous embodiments, opposite the projection 46, the support member 36 includes a number of attachment members 50, as best shown in FIGS. 13-16. The attachment members 50 extend outwardly from the support member 36 and each includes a blind bore 52 therein. The attachment members 50 are disposed around the opening 48, and taper inwardly towards the opening 48 and are separated from one another by the flat sections 56. Around the attachment members 50 and flat sections 56 are located a number of projections 352 extending outwardly away from the flange 58. The projections 352 have an exterior surface 354 that is configured to engage one end 356 of the biasing members 358, (FIGS. 11A-12) and which can have any desired form, but in the current embodiment are formed as compression springs 360 with the first end 356 and a second end 362 disposed opposite the first end 356. The springs 360 preferably have a generally cylindrical shape in order to be more readily engaged with the projections 352, but can be formed to have any suitable shape complementary to and easily engageable with the projections 352. In addition, the springs 360 are engaged axially around the exterior surfaces 354 of the projections 352 in any suitable manner, such as by mechanically, adhesively, etc., engaging the end 356 with the surface 354 of the projection 352, to retain the end 356 of the spring 360 in engagement with the support member 36.

The opposed end 362 of each of the springs 360 extends outwardly beyond the projections 352 of the support member 36 in order to resiliently engage the support member 36 with a locking member/ring 364, as best shown in FIGS. 11A-12 and 17-20. The locking member/ring 364 is formed essentially as a combination of the ring 120 and the locking member 132 of the prior embodiments. The locking member/ring 364 includes an interior member 366 having an outer periphery 368 from which extends an exterior member 370. The interior member 366 is formed with a central section 372. The central section 372 defines a central opening 373 that is positioned in alignment with the opening 48 in the support member 36 to enable the shaft 26 to extend therethrough. In addition, a number of inwardly extending teeth 375 are positioned around the periphery of the central opening 373, and a number of flanges 374 are disposed, preferably spaced equidistant from one another and formed to expand outwardly from the central section 372. The flanges 374 each include a tab 376 located along one side of the flange 374 adjacent the wide end of the flange 374. The tab 376 projects outwardly generally perpendicular to the flange 374 from each side of the flange 374. The portion of the tab 376 disposed adjacent the support member 36 functions in part to retain the spring 360 engaged with the flange in alignment with the flange 374, thereby maintaining constant engagement between the spring 360 an the flange 374 to bias the locking member/ring 364 away from the support member 36.

Opposite the central section 372, the wide ends of each flange 374 are each connected to an interior surface 378 of the exterior member 370. The exterior member 370 is generally cylindrical in shape, such that the interior member 368 is disposed completely within the exterior member 370. The flanges 374 and exterior member 370 define a number of spaces 380 therebetween which are disposed in alignment with the attachment members 50. The exterior member 370 has a sufficient inside diameter so as to be larger than the outside diameter of the rim 42 of support member 36, thereby allowing the support member to be positionable within the exterior member 370. In addition, the inside diameter of the exterior member 370 is sized such that the exterior member 370 is able to rotate freely about the circular rim 42 of support member 36 of device 10 with a minimal transverse motion such that the rim 42 of support member 36 axially locates the exterior member 370. Likewise, the exterior member 370 is free to translate axially along support member 36 under the bias of the springs 360 engaged between the support member 36 and the locking member/ring 364.

The exterior surface 382 of the exterior member 370 includes a number of raised portions 384 disposed therearound that enable the locking member/ring 364 to be easily grasped and rotated by an individual when in use. Further, at the end of the exterior surface 382 opposite the support member 36, the surface 382 includes a rim 386 extending axially from the circumference of the exterior surface 382 and on which is disposed indicia 387 relating to the particular gear ratios at which the tool 10 is operating.

As best shown in FIGS. 11A-12 and 21-24, instead of the cover 66, the tool 10 includes a plate member 388 positioned adjacent the locking member/ring 364 opposite the support member 36. The plate member 388 is formed of any suitable material and includes a central aperture 77 aligned with the opening 373 in the ring 364 to enable the shaft 26 to pass therethrough. Around the aperture 77 are disposed a number of equally spaced bores 78 alignable with the bores 52 in the attachment members 50 in the support member 36 and can receive the screws 80 used to affix the planetary gears 90 to the plate member 388. This, in turn, secures the plate member 388 to the support member 36, with the ring 364 movably positioned therebetween.

The plate member 388 also has a number of bores 392 disposed in between each pair of adjacent bores 78. The bores 392 are used to receive pins 393 therein that project through the spaces 380 in the plate member 388 and into engagement within the blind bores 52 hold the mechanism 344 together. In this manner, the rotation of the ring 364 is limited with regard to the support member 36 and plate member 388, and the end of the springs 360 opposite the projections 352 is maintained in engagement with the flanges 374 to provide a constant biasing force between the support member 36 and the locking member/ring 364.

Spaced from the aperture 77 on the exterior periphery of the plate member 388 are a number of stops 394. The stops 394 extend perpendicularly from the plate member 388 axially inwardly towards the ring 364. The stops 394 are preferably equidistantly spaced around the plate member 388 in alignment with and extending at least partially through the spaces 380 and include a first stop 396 and a second stop 398. The first stop 396 is formed to have a height less than that of the second stop 398, and is separated from the second stop 398 by a notch 400. The first stop 396 is additionally separated from the plate member 388 by a groove 402 formed in the plate member 388 immediately adjacent the first stop 396. The notch 400 and the groove 402 are formed to have a depth sufficient to receive and retain the tab 376, thereby holding the ring 364 at that position with respect to the support member 36 and the plate member 388.

Opposite the stops 396, 398, the plate member 388 includes a number of recesses 404 formed in the body of the plate member 388. The recesses 404 reduce the overall weight of the plate member 388 such that the tool 10 is easier to manipulate as desired.

Figure 26:
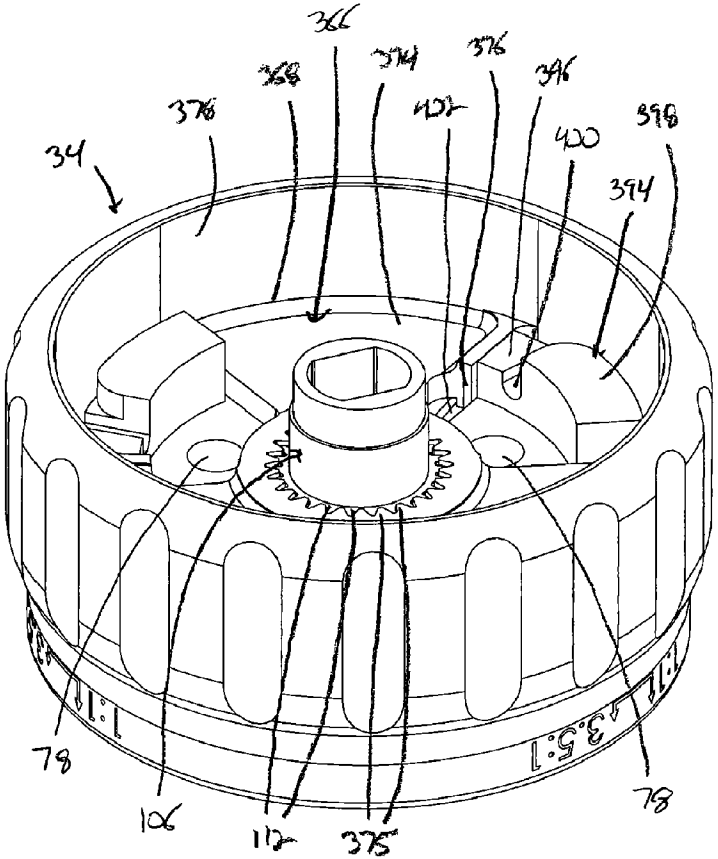
FIG. 26 is an isometric view of the locking member in an engaged position.
Figure 25:
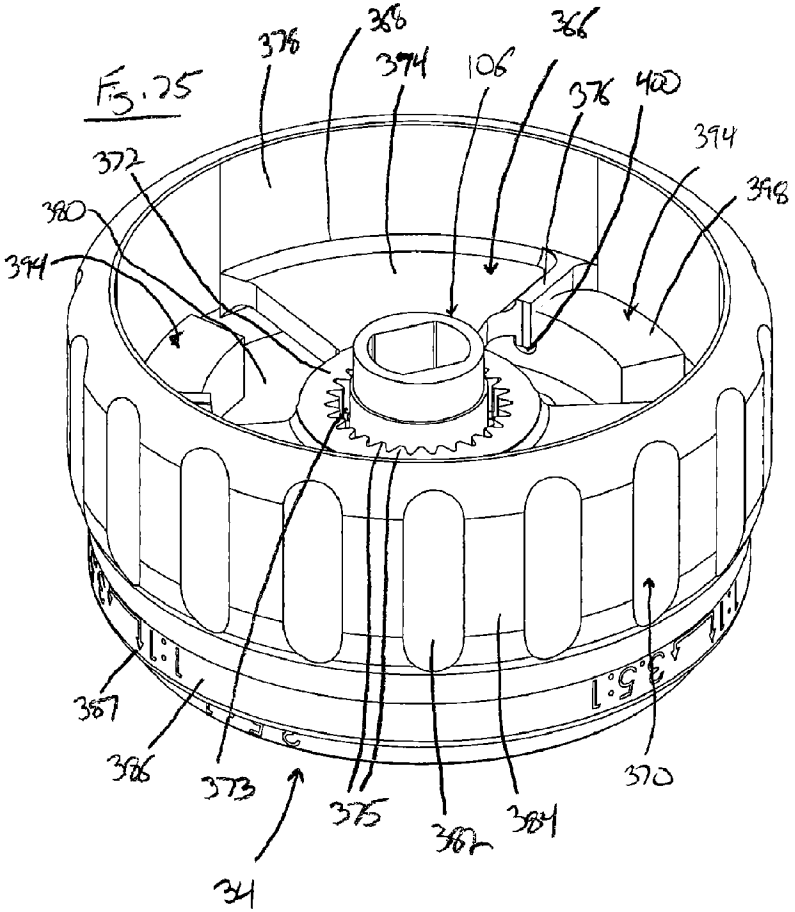
FIG. 25 is an isometric view of the locking member in a disengaged position.

In operation, to shift the gear ratio of the mechanism 34, the ring 364 is grasped and urged towards the handle 28 and support member 36. This motion disengages the tab 376 from within either the notch 400 or the groove 402 depending on the amount of movement of the ring 364. In this position, the ring 364 can then be rotated to align the tabs 376 with either the notch 400 or the groove 402. At that position, the ring 364 can be released, and the bias of the springs 360 will urge the tabs 376 into engagement with the notch 400 or the groove 402. When the tabs 376 are positioned in engagement with the notch 400, as best shown in FIG. 25, the teeth 375 within the central opening 372 are disengaged from the sun gear 106 on the shaft 26, such that the mechanism 34 operates in a ratio of other than 1:1, which can be selected as desired based on the number of teeth 94, 104, 112, on the respective gears 90, 100 and 106, but that is preferably selected to be a ratio of between 2:1 to 5:1, and more preferably a ratio of 3.5:1. Alternatively, when the tabs 376 are engaged within the grooves 402, as best shown in FIG. 26, the teeth 375 on the central section 372 of the interior member 366 of the ring 364 are engaged with the teeth 112 on the sun gear 106, such that the mechanism 34 operates in a ratio of 1:1.

Various other alternatives are contemplated is being within the scope of the following claims particularly pointing out and distinctly claiming the subject matter regarded as the invention.

We claim:

1. A driving tool comprising:

a) a housing having an open end;

b) a shaft operably connected to the housing and disposed at least partially within the open end;

c) a gear assembly at least partially disposed within the housing and engaged with the shaft;

d) a gear ratio switching mechanism engaged with the gear assembly, the switching mechanism including a selector ring integrally formed with a locking member; and e) at least one biasing member configured to continuously urge the locking member into engagement with the gear assembly, wherein the biasing member is engaged on a support member opposite the locking member, wherein the gear ratio switching mechanism further includes a plate member affixed to the support member to position the locking member therebetween, wherein the plate member including at least one notch and at least one groove engageable with the locking member.

2. The driving tool of claim 1 wherein the at least one biasing member is a coil spring.

3. The driving tool of claim 1 wherein the locking member further comprises at least one tab releasably engageable with one of the notch or the groove in the plate member.

4. The driving tool of claim 1 wherein the plate member is affixed to the support member by a number of fasteners that rotatably mount a number of planetary gears to the plate member opposite the locking member.

5. The driving tool of claim 4 wherein the locking member includes a central opening having a number of teeth positioned around a periphery of the central opening, the teeth releasably engageable with a sun gear disposed on the shaft.

6. The driving tool of claim 1 wherein the selector ring forms an exterior member of the switching mechanism and the locking member forms an interior member of the switching mechanism.

7. The driving tool of claim 6 wherein a number of spaces are formed between the exterior member and the interior member of the switching mechanism.

8. The driving tool of claim 7 wherein the plate member is affixed to the support member by a number of fasteners extending through the spaces formed in the switching mechanism to position the interior member of the switching mechanism therebetween.

9. The driving tool of claim 8 wherein the fasteners rotatably mount a number of planetary gears to the plate member opposite the locking member.

* * * * *